United States Patent [19]

Meyer et al.

[11] 4,219,198

[45] Aug. 26, 1980

[54] AMUSEMENT DEVICE

[75] Inventors: Burton C. Meyer, Downers Grove; Ralph J. Kulesza, Chicago, both of Ill.

[73] Assignee: Marvin Glass & Associates, Chicago, Ill.

[21] Appl. No.: 872,428

[22] Filed: Jan. 26, 1978

[51] Int. Cl.[3] ..... A63F 9/02

[52] U.S. Cl. ..... 273/399; 46/42; 273/317

[58] Field of Search ..... 46/42; 248/514; 273/399

[56] References Cited

U.S. PATENT DOCUMENTS

| | | | |
|---|---|---|---|
| 1,452,835 | 4/1923 | Goldman | 46/42 |
| 1,469,705 | 10/1923 | Van Winkle | 46/1 R |
| 1,617,846 | 2/1927 | Hawk | 46/42 |
| 2,506,260 | 5/1950 | Taggy | 46/42 |
| 3,298,692 | 1/1967 | Glass et al. | 46/42 |
| 3,300,891 | 1/1967 | Glass et al. | 46/42 |
| 3,445,114 | 5/1969 | Fernandez | 273/105 R |
| 3,881,269 | 5/1975 | Timmons | 248/514 |

FOREIGN PATENT DOCUMENTS

| | | | |
|---|---|---|---|
| 440375 | 1/1926 | Fed. Rep. of Germany | 46/42 |

*Primary Examiner*—Anton O. Oechsle

*Attorney, Agent, or Firm*—Mason, Kolehmainen, Rathburn & Wyss

[57] ABSTRACT

This invention relates to an amusement device which will provide an amusing series of events, in a chain reaction fashion, culminating in the entrapment of a playing piece. A first element is selectively actuated which causes the release of a first ball down a ramp and the activation of a second element which permits a fanciful ladder element to be released down a spiral post. This latter action drives a third element causing the release of a second ball which ultimately actuates an ejector device which propels a playing piece through the air. The first released ball if properly aimed and timely released has preset a target element for receipt of the playing piece which actuates closure of the target element due to its weight.

5 Claims, 5 Drawing Figures

Fig 2
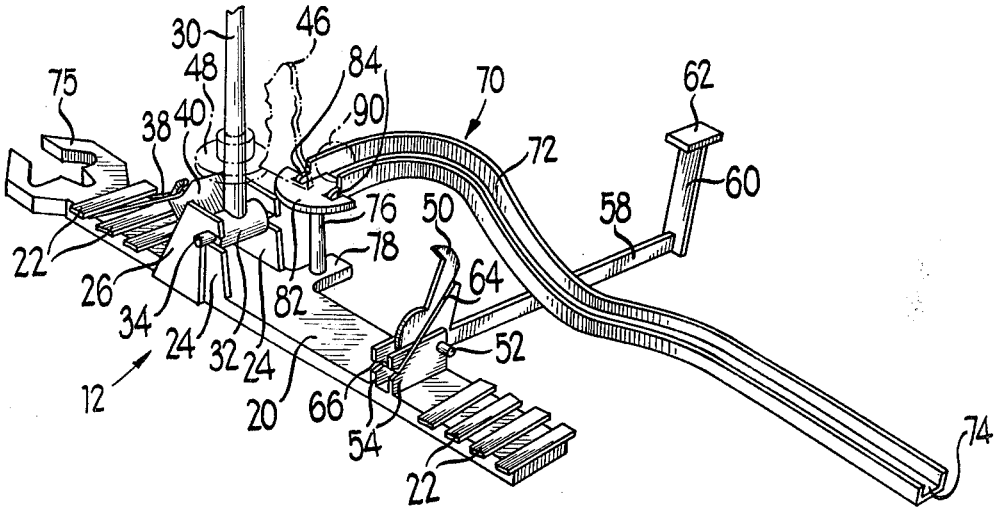
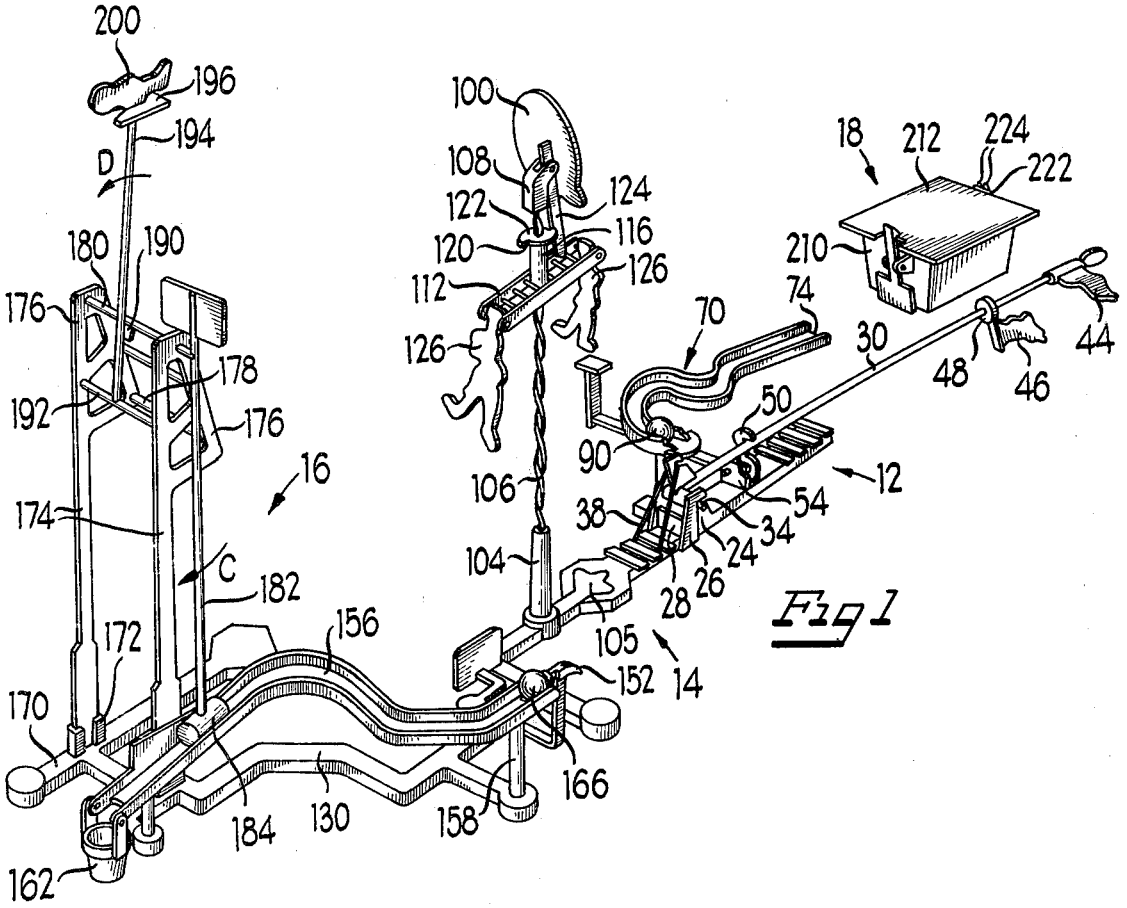
Fig 1

AMUSEMENT DEVICE

BACKGROUND OF THE INVENTION

1. Field of the Invention

This invention relates generally to amusement devices, and in particular to a device which performs an amusing series of events.

2. Brief Description of the Prior Art

In the past, various amusement devices have been proposed to generate a series or chain reaction of events. Many such devices have also proven useful in the teaching of various scientific principles as well as providing the fun and enjoyment for its players. Amusement devices of this type have also been used as timing devices, for example, in a game apparatus, since the occurrence of the chain reaction or series of events usually occurs within a predetermined period of time. One such device is shown in U.S. Pat. No. 3,298,692. The present invention provides a new and improved amusement device within this category.

SUMMARY OF THE INVENTION

This invention relates to an amusement device which is initiated by the user to provide, in a chain reaction fashion, an amusing series of events culminating in the capture of a playing piece. A first element is selectively actuated to cause the release of a first ball down a ramp. The first element also trips a second element causing a fanciful ladder element to be released down a spiral post. This latter action trips a third element permitting the release of a second ball which ultimately actuates an ejector device which propels a playing piece through the air. The first ball, if timely released and properly aimed, has preset a target element for receipt of the playing piece which actuates closure of the target element due to its weight.

The set-up, placement and arrangement of the various elements is an important function to be performed by the user, since, improper set-up may permit a break in the chain reaction of events. Therefore, the device is useful as a teaching or educational device, for demonstrating physical laws, and well as an amusement device.

BRIEF DESCRIPTION OF THE DRAWINGS

FIG. 1 is a perspective view of the present invention wherein the component elements are shown in their preset or cocked position;

FIG. 2 is a perspective view, on an enlarged scale, generally from the opposite direction, showing the first element in its released position;

DESCRIPTION OF THE PREFERRED EMBODIMENT

Figure 5:
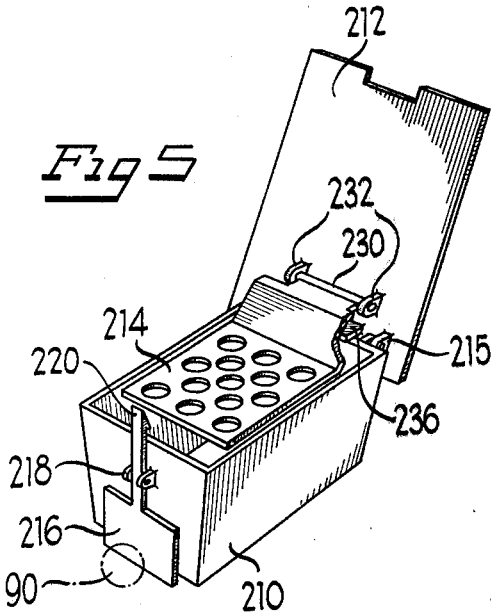
FIG. 5 is a perspective view, on an enlarged scale, of the target element in its open, preset position.

An amusement device made in accordance with the concepts of the present invention is shown in FIG. 1, generally designated 10. The amusement device 10 includes a first element generally designated 12 (FIG. 2), a second element 14 (FIG. 3), a third element, generally designated 16 (FIG. 4), and a target element or device generally designated 18 (FIG. 5). The actuation and operation of the amusement device provides an amusing series of events in a chain reaction fashion, culminating in the entrapment of a playing piece in the target device 18. The manual set-up, placement and arrangement of the various elements is performed by the players of the game and often determinative of the outcome. Improper set-up may permit a break in the chain reaction of the events. As a result, the amusement device can also be used as a teaching or educational device for demonstrating physical laws of nature, timing, and the like.

The first element 12, referring to FIG. 2, includes a generally flat, rectangular elongated base portion 20 which includes a plurality of simulated railroad ties 22 on each end as shown. A first pivot support mechanism is provided by a pair of upstanding flanges 24, which in the preferred embodiment, are shown to be integrally molded at opposite sides of the base 20. An encapsulating member for the pivot includes a pair of vertical flanges 26 which are connected to one another by a horizontal rib element 28. A flagpole 30 is secured to a cylindrical base 32 which is pivotally mounted by its reduced ends 34 within pivot points provided by the flanges 24 and 26. Biasing means in the form of a rubber-band 38 is removably secured to a notched rearwardly extending flange 40 connected to the base 32 of the flagpole. The biasing means 38 is adjustable to provide varying tension by connection around a predetermined one of the ties 22.

The flagpole 30 carries on its free end a top flag 44 which is rotatably secured to the top of the pole 30 and a sliding or bottom figure or flag 46 which is slidably mounted on the pole 30 by an annular ring 48. In its cocked position, referring to FIG. 1, the flagpole 30 is maintained in a generally horizontal position by a catch or pawl 50 engaging the top side of the pole and maintaining it against movement under the force of the biasing means 38. The catch 50 is pivotally mounted by a shaft 52 in a pair of upstanding flanges 54 which may be integrally molded with the base 20. An arm 58 is secured to the catch 50 and extends outwardly to support a manual pushbutton or actuator 60 having a flat finger engaging tab 62 on its uppermost end. The catch 50 is biased by a similar band 64 in a clockwise direction as shown in FIG. 2, secured in notches 66 formed in the flanges 54. Thus, the chain reaction of events is initiated by downwardly depressing the pad 62 which rotates the catch 50 permitting the pole 30 to pivot upwardly under the influence of the band 38.

The upward pivoting of the pole 30 causes the flag or figure 46 to descend due to the influence of gravity. A curved slide element, generally designated 70, is mounted adjacent one of the flanges 24 as shown in FIG. 2. The slide includes a generally U-shaped channel 72 which, at one end 74, rests on the supporting surface. The other end of the slide 72 is supported by a post 76 secured to a tab extension 78 of the base 20.

A release mechanism is provided on the top end of the slide in the form of a generally semi-circular pad 82. The pad 82 includes a pair of slots which slip over a suitable pair of matched tabs 84 for supporting the pad in a generally downwardly tilted orientation along the rise of the slide 42. Just inwardly of the end of the release pad 82, an upstanding rib on the bottom of the slide 70 permits a marble 90 to be placed at the top of the slide 72 without rolling down the slide. However, when the flagpole assumes a vertical position (as shown in FIG. 2), the figure 46 drops downwardly and engages the outer or free end of the release pad 82 causing the inner end to pivot upwardly lifting the marble 90 over the ridge on the slide for free rolling movement down the slide.

Figure 3:
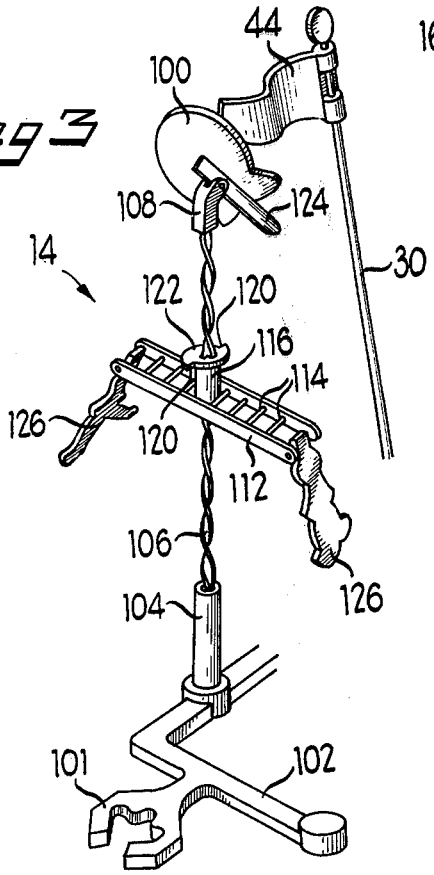
FIG. 3 is a perspective view, on an enlarged scale, showing the second element in a position after release.

Substantially simultaneously with the release of the marble 90, referring to FIG. 3, the upper flag 44 engages an actuator 100 mounted on the top of the second element 14.

The second element 14 includes a generally L-shaped base 102 having an upstanding post 104 on the end of the short leg portion. A spiral or twisted shaft 106 extends vertically upwardly from the post 104 and supports a mounting member 108 at its upper end. The mounting member 108 pivotally mounts the actuator 100 at a predetermined height such that the flag 44 on the pole 30 will strike the actuator 100 above the pivot point on the mounting member 108.

Figure 4:
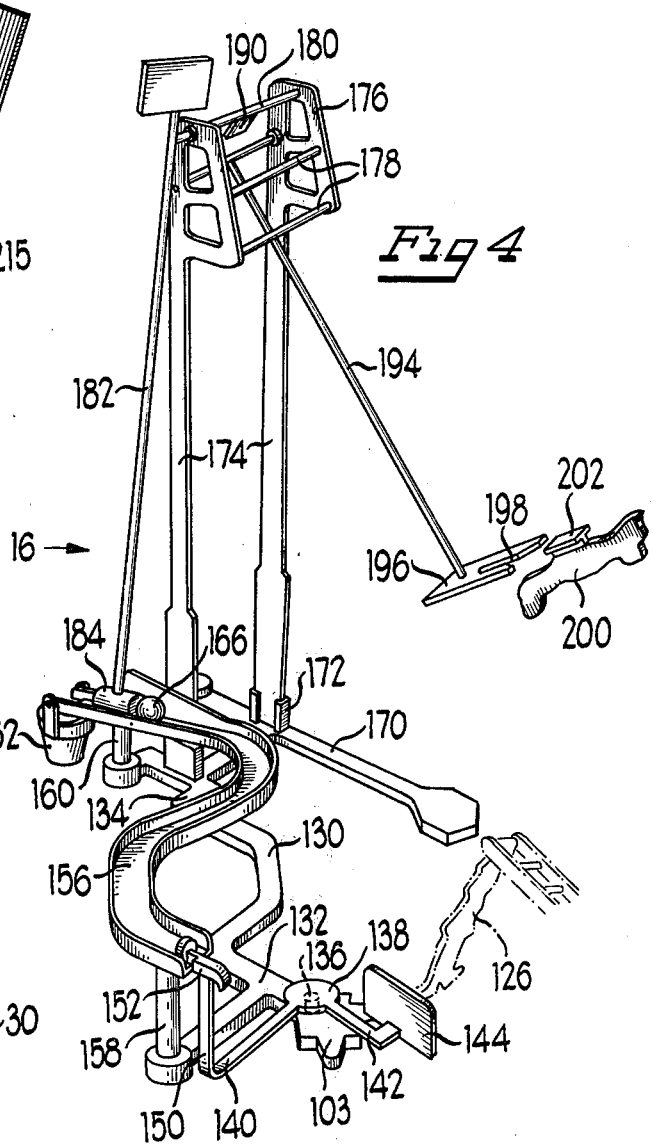
FIG. 4 is a perspective view of the third element in its released position.

A generally horizontal element 112, which in the preferred embodiment is shown in the form of a miniature ladder having a plurality of rungs 114, is mounted on the twisted shaft 106 by a hub 116. The hub includes an axial slot which engages the shaft 106 and rotates when moved upwardly or downwardly with respect to the shaft 106. The hub includes a pair of radially extending flat surfaces 120 on a flange portion 122 so that when in its uppermost position as shown in FIG. 1 one of the two surfaces 120 will engage a depending arm 124 on the actuator 100. In the embodiment as shown, a pair of figures 126 are pivotally mounted at opposite ends of the ladder 112 and will swing generally outwardly therefrom, due to centrifugal force, as the ladder and hub traverse down the shaft 106. It can be seen with respect to FIG. 3 that when the flag 44 impinges the actuator 100, the outward pivoting of the arm 124 releases the hub 116 permitting the ladder 112 and figures 126 to descend while rotating in a counterclockwise direction when viewed from the top. As the ladder 112 approaches the bottom of the twisted shaft 106, the third element (FIG. 4) is actuated. The third element 16 includes a base 130 which extends from a "T" shaped right end 132 as shown in the foreground of FIG. 4 to a generally "Y" shaped section 134 shown in the left or background of FIG. 4. The T-shaped element 132 at the right of the crossbar provides a pivot point or pivot pin 136 for mounting the hub 138 at the joinder of two arms 140 and 142 extending at 90° with respect to one another. The shorter arm 142 supports a vertical actuating plate 144 at the precise elevation so that the descending figures 126 will hit the plate 144 causing a clockwise rotation of the arms 142 and 140 to drive a hammer 150 forwardly. The head 152 of the hammer 150 extends within the trough or channel portion of another slide 156 which is mounted on the leg of the T-shaped base element by an upstanding post 158. The slide 156 travels downwardly along a curved path and terminates just past a second support post 160 at a position above a bucket 162 pivotally supported on the end of the slide 156.

Referring again to FIG. 1, the slide includes means to maintain a ball or marble 166 at its uppermost end. This means may include a detent or rib formed on the slide. Thus, impingement of the figure 126 on the plate 144 causes the hammer head 152 to strike the marble causing it to roll down the slide 156.

This third element 16 includes an ejector mechanism comprising a generally H-shaped base portion 170 and opposed pairs of vertically extending channels 172 for removably supporting a pair of identical geometric forms 174. At the upper end, each of the forms 174 includes an enlarged structural element 176, generally in the form of a letter A, which are connected to one another by a pair of stationary shafts or struts 178. The uppermost shaft 180 is pivotally mounted in apertures formed on either structural element 176 and includes on one end a securely fastened downwardly extending shaft or pole 182. The shaft 182 includes a hammer or mallet head 184 on its lowermost end which rides within the slide or channel 156 for pivotal movement about the shaft axis 180. The center of the shaft 180 includes a securely fastened or integrally molded flange 190 which, in the preset condition as shown in FIG. 1, extends generally vertically downwardly.

A second rotatable shaft 192 is mounted slightly forwardly of the shaft 180 between the structural elements 176 as best seen in FIG. 1. A radially extending shaft 194 is securely fastened or integrally molded to the center point of the shaft 192 and, in the preset condition, extends generally vertically upwardly as shown. A projectile mounting shoe 196 is mounted on the end of the shaft 194 perpendicular thereto. The show 196 includes a V-slot or U-slot 198 for slidably mounting a figure 200 by means of a T-shaped element 202 which fits within the U-slot 198. Thus, when the marble 166 engages the mallet head 184, the shaft 182 pivots in a generally clockwise direction as shown by arrow C in FIG. 1 causing the flange 190 to move the vertical pole 194 in a counterclockwise direction as shown by arrow D, past a vertical, overcenter point, for falling revolution caused by gravitational forces. As the arm 194 rotates, as best seen in FIG. 4, it passes a vertically downwardly directed orientation to the point as shown where the arm 194 hits the stationary strut 178 thus stopping the arm 194 and shoe 196 and ejecting the figure 200 out of the V-slot 198. The figure 200 is thus launched towards the target device 18.

Referring to FIG. 5, the target device includes a generally rectangular base portion 210, a lid 212, and a basket element 214. The lid 212 is pivotally mounted by a hinge 215 to one side of the base. A target or actuator pad 216 is pivotally mounted by a hinge 218 on the front wall of the base 210. A catch or release element 220 engages the top 212 and maintains the lid in a closed position as shown in FIG. 1. Biasing means in the form of a rubberband 222 is wrapped about two posts 224 formed on the rear of the top lid 212 at a position rearwardly of the pivot point of the hinge 215 to bias the lid upwardly to the position as shown in FIG. 5.

As discussed previously, the ball 90 has been released by the descending FIG. 46 to travel down the slide 72 toward the end 74 adjacent the supporting surface. If the target device is properly positioned, the marble 90 will be directed from the slide into engagement with the pad 216 causing the catch 220 to pivot and release the top 212 so that it can pivot upwardly to its position as shown in FIG. 5. At this point, the biasing means 222 slips off of the two posts 224. The basket 214 is pivotally secured by a pin 230 between a pair of depending flanges 232 to the lid or top 212 and is carried upwardly to the position as shown in FIG. 5 under the force of the biasing means 222. A second depending flange 236 on the lid 212 supports the basket 214 in a generally horizontal orientation. In addition to the placing of the target device 18 in alignment with the path of travel of the marble 90, it is also the intent that the user place the target device 18 in such a position that the ejected or launched figure toy 200 is caused to fly through an arcuate path of travel and land directly on the basket 214 which, due to the added weight of the figure toy, causes the lid 212 of the target device to close. Thus, it can be seen that accurate placement of the target device to be impinged by the ball 90 and timely actuated to open the target device 18 prior to the arrival of the launched figure 200. The base 102 of the second element includes a pair of connectors 101 and 105 which mate with suitably shaped connectors 103 on the third element 16 and 75 on the base of the first element 20.

The foregoing detailed description has been given for clearness of understanding only and no unnecessary limitations should be understood therefrom as some modifications will be obvious to those skilled in the art.

We claim:

1. A game apparatus, comprising:

a first element having a manual trip mechanism and an arm biased for upward pivotal movement upon actuation of said trip mechanism;

a slider on said biased arm for downward movement due to gravity when said arm is generally vertically oriented;

second and third elements in proximity to said first element and each having trip means for actuation by said arm and said downwardly moving slider, respectively, said trip means releasing first and second weighted objects for movement under the influence of gravity;

a fourth element in proximity to said second element for engagement by one of said weighted objects, said fourth element including release means actuated by said weighted object and launching means associated with said release means for launching a playing piece; and said first, second and third elements each including support bases for supporting the elements on a suitable supporting surface in a spatial arrangement.

2. The game apparatus of claim 1 including a device for free positioning on the supporting surface by the players of the game in an attempt to receive said launched playing piece.

3. The game apparatus of claim 2 wherein said device includes means movable between a preset position and an open position in response to actuation thereof by the other of said weighted objects when said device is placed on said supporting surface so as to intercept the other of said weighted objects in its movement under the influence of gravity.

4. A game apparatus, comprising:

a first element having a manual trip mechanism and an arm biased for upward pivotal movement upon actuation of said trip mechanism;

a slider on said biased arm for downward movement due to gravity when said arm is generally vertically oriented;

second and third elements in proximity to said first element and having trip means for actuation by said arm and downwardly moving slider, respectively, said trip means releasing a pair of weighted objects for movement under the influence of gravity; and a fourth element in proximity to said second element for engagement by one of said weighted objects, wherein said weighted objects include a ball released for movement down a directional ramp element and a rotating element, said rotating element comprising a pair of figures pivotally mounted to the ends of a transverse support bar, said transverse support bar mounted by a spiral shaft causing the figures to pivot outwardly as the bar rotates and descends down the shaft.

5. A game apparatus, comprising:

a first element having a manual trip mechanism and an arm biased for upward pivotal movement upon actuation of said trip mechanism;

a slider on said biased arm for downward movement due to gravity when said arm is generally vertically oriented;

second and third elements in proximity to said first element and each having trip means for actuation by said arm and downwardly moving slider, respectively, said trip means releasing a pair of weighted objects for movement under the influence of gravity; and a fourth element in proximity to said second element for engagement by one of said weighted objects wherein said fourth element includes release means which comprises a pivotal hammer engageable by one of said weighted objects for contacting a third element sphere, said fourth further including a tortuous channel for directing the sphere along said path to define a time delay.

* * * * *